US006163675A

United States Patent [19]

Kido et al.

[11] Patent Number: 6,163,675

[45] Date of Patent: Dec. 19, 2000

[54] IMAGE FORMING APPARATUS

[75] Inventors: Eiichi Kido, Yamatokoriyama; Shigeyuki Wakada; Toshihide Ohgoshi, both of Nara, all of Japan

[73] Assignee: Sharp Kabushiki Kaisha, Osaka, Japan

[21] Appl. No.: 09/502,003

[22] Filed: Feb. 11, 2000

[30] Foreign Application Priority Data

Feb. 26, 1999 [JP] Japan ..... 11-049399

[51] Int. Cl.[7] ..... G03G 15/16

[52] U.S. Cl. ..... 399/313; 399/66

[58] Field of Search ..... 399/66, 167, 297, 399/302, 308, 313, 318, 396, 400

[56] References Cited

U.S. PATENT DOCUMENTS 5,735,832 4/1998 Yoshiuchi ..... 399/384
6,088,567 7/2000 Miyashiro et al. ..... 399/400

FOREIGN PATENT DOCUMENTS 2-173677 5/1990 Japan .

*Primary Examiner*—Arthur T. Grimley
*Assistant Examiner*—Hoang Ngo

[57] ABSTRACT

An image forming apparatus, includes: a rotatable photosensitive member; a charging brush for uniformly charging the photosensitive member; a light scanning and irradiating portion for illuminating the photosensitive member scanwise; a developing roller for supplying the toner to the static latent image on the photosensitive member to create a toner image; and a rotatable transfer roller arranged opposing the photosensitive member and urged against the photosensitive member by urging elements arranged around both ends thereof for allowing the toner image to a print medium. In this arrangement, the peripheral surface speed of the transfer roller is set at a speed slower, by less than about 2.3%, relative to the peripheral surface speed of the photosensitive member, and the length of the transfer roller is set shorter by the distance not exceeding about 6 mm than the maximum width of the reproducible print media, in the direction of the length.

4 Claims, 8 Drawing Sheets

IMAGE FORMING APPARATUS

BACKGROUND OF THE INVENTION (1) Field of the Invention

The present invention belongs to the technical field of image forming apparatus and more detailedly relates to an image forming apparatus such as a copier, printer, etc., which uses a transfer roller for transferring the toner image from an image support to print media.

(2) Description of the Prior Art

Conventionally, in image forming apparatus such as copiers, printers, etc. which use the so-called method of electrophotography using a toner as the developer, the corona transfer method, which effects corona discharge from the rear surface of the print medium, has been widely used in order to transfer the toner image formed on the photosensitive member to the print medium such as recording paper etc.

This corona transfer method needs application of a high voltage of some kilo volts in order to cause corona discharge. Therefore, this configuration needs a high voltage circuit and insulating countermeasures, resulting in high cost for the apparatus. Further, there is a problem in that ozone which is generated from electric discharge oxidizes and damages the apparatus components, especially causing shortening the photosensitive member's life.

In order to solve this problem, a roller transfer method has been proposed in which a cylindrical transfer roller is closely abutted against the photosensitive member with the recording paper in between. This roller transfer method performs transfer of the toner image by bringing the conductive transfer roller set at a fixed voltage into the rear surface of the recording paper. Typically, a voltage of some hundred volts to about 2.0 KV is applied to the transfer roller so as to perform the transfer operation.

Since the roller transfer method will generate no or less ozone compared to the corona transfer method, this method is beneficial for environmental preservation. Further, the voltage applied to the transfer roller can be set at voltage lower than that of the conventional configuration, a high voltage board for high voltage application can be made compact. Moreover, there is another advantage of less toner scatter and less disturbance of the image since the recording paper can be in close contact with the photosensitive member.

With the development of information processing devices towards personal use, image forming apparatus have been made simple, compact and low-priced but still there have been a strong demand for an image forming apparatus such as an electrophotographic copier, printer, and the like which is able to perform a stable transfer operation using a low voltage. For these reasons, many of recent, compact printers use the roller transfer method as stated above to make the apparatus compact.

Up to now, various types of compact printers using transfer roller configurations have been proposed. For example, Japanese Patent Application Laid-Open Hei 2 No.173677 discloses an image forming apparatus in which the length of the charging device is set greater than the length of the transfer device while the maximum print media width is set smaller than the length of the transfer device in order to protect the edges of the charging device from dirt and enable uniform charging over the image support surface over a prolonged period. FIG. 1 shows a case where the maximum width W1 of the print medium P (print paper) is set smaller than the transfer roller length W2.

However, the conventional roller transfer techniques have the problem in that the combined effect of the abutment force for pressing the transfer roller against the photosensitive member and hard substances such as calcium carbonate etc., contained in the print media lessens the coating thickness of the photosensitive member with the augmentation of the image forming in number, leading to lowering of the electrified potential and lowering of the surface potential after exposure hence causing marked degradation of the image quality.

FIG. 2 is a chart showing the relationship between the operating time of a photosensitive member and its coating thickness. For example, it is understood that when the operating time of the photosensitive member was 250 K seconds, the coating thickness of the photosensitive member was 20 $\mu$m (point P in the chart) and the coating thickness reduced to 15 $\mu$m at the operating time of 420 K seconds (point Q in the chart).

In this case, as the operating time of the photosensitive member (the number of image formations) increased, the coating thickness which had been 25 $\mu$m at the initial stage reduced to 5 $\mu$m or lower after 600 K seconds. FIG. 3 is a chart schematically showing the relationship between the surface potential and residual potential over the above period. As understood from this chart, with increase in the operating time of the photosensitive member, the surface potential reduced stepwise while the residual potential increased stepwise resulting in decrease in the difference between the surface potential and the residual potential.

In an image forming apparatus of a reversal development type, which is currently predominant, as shown in FIG. 4, as the electrified potential V0 of the photosensitive member decreases with the reduction in coating thickness of the photosensitive member, the difference between the electrified potential V0 and the developing bias DVB, or so-called background margin decreases, causing fogging in the non-image area and degradation of the image quality.

If fogging occurs as above, extra toner which is not needed for development will adhere to the photosensitive member surface, which increases toner consumption and hence the running cost and servicing cost. Further, this will also degrade and abrade the cleaning blade at an early stage.

Further, as shown in FIG. 5, the transfer roller is urged at its ends, upward in the figure with urging members such as springs etc., so as to abut itself against the photosensitive member. Both ends of the transfer roller come in close contact with the photosensitive member because of their being close to the points urged by the springs while the mid part of the transfer roller is set warped so as to be away from the photosensitive remember.

Particularly, since the contact pressure at the both ends of the photosensitive member is greater than that at the mid part thereof, hard substances such as calcium carbonate etc., are liable to come off from both edges of the print media and adhere to the photosensitive member, so that combination of the mechanical pressure and the abrasive functions of the hard particles accelerates the wear at both ends of the photosensitive member, causing difficulties in maintaining stable image quality over a prolonged period of time.

SUMMARY OF THE INVENTION

The present invention has been devised in view of the above prior art problems and it is therefore an object of the present invention to inhibit the reduction in coating thickness of the photosensitive member in an image forming apparatus using a roller transfer method, in particular, the reduction in coating thickness around both ends, to thereby lengthen the photosensitive member's life and hence stably provide images of good quality over a prolonged period.

It is another object of the present invention to provide an image forming apparatus with which maintenance cost and servicing cost can be cut down by reducing the frequency of maintenance works and repair jobs such as exchange of the photosensitive member due to reduction of the coating at an early stage, toner re-supply accompanied by extra toner consumption and periodical exchange of wearout parts, and the like.

In order to achieve the above object, the present invention is configured as follows:

In accordance with the first feature of the invention, an image forming apparatus, includes: a rotatable image support; a charger for uniformly charging the image support; a light scanning and irradiating portion for illuminating the charged image support so as to form a static latent image thereon; a developing portion for supplying the developer to the static latent image on the image support to create a developer image; and a transfer roller rotatably arranged opposing and in abutment with the image support and urged against the image support by urging elements arranged around both ends thereof for transferring the developer image on the image support to a print medium, and is characterized in that the peripheral surface speed of the transfer roller is set at a speed slower, by less than about 2.3%, relative to the peripheral surface speed of the image support, and the length of the transfer roller with respect to the longitudinal direction is shorter than the maximum width of the image formable print media with respect to the longitudinal direction.

In accordance with the second feature of the invention, the image forming apparatus having the above first feature is characterized in that the length of the transfer roller with respect to the longitudinal direction is set shorter by the distance not exceeding about 6 mm than the maximum width of the image formable print media with respect to the longitudinal direction.

In accordance with the third feature of the invention, the image forming apparatus having the above first feature is characterized in that the outside diameter at both ends of the transfer roller is smaller than that in the middle portion thereof and the both ends of the transfer roller is formed stepwise.

In accordance with the fourth feature of the invention, the image forming apparatus having the above first feature is characterized in that the transfer roller is constituted such that the hardness of each of the end portions is lower than that of the middle portion.

DESCRIPTION OF THE PREFERRED EMBODIMENTS

Figure 1:
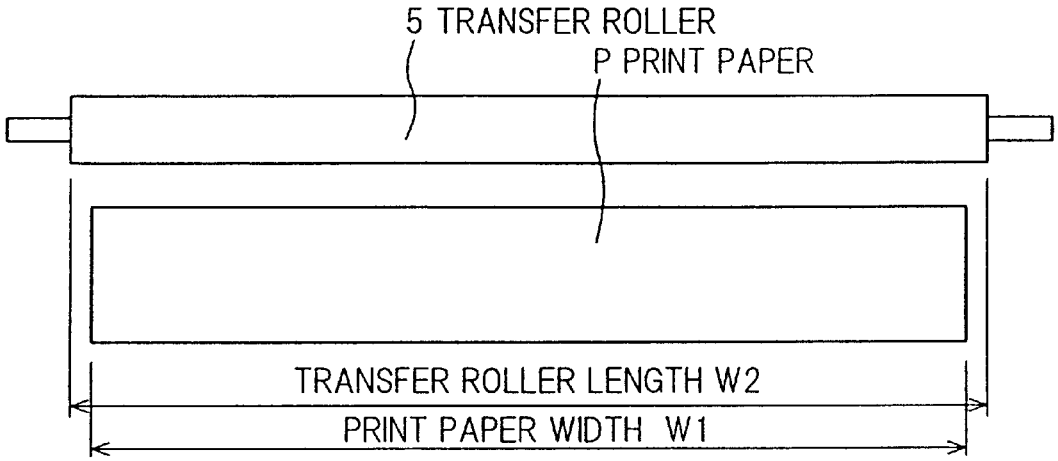
FIG. 1 PRIOR ART
FIG. 1 is a diagram showing the relationship between the dimensions of a transfer roller and the size of paper in a conventional configuration.
Figure 2:
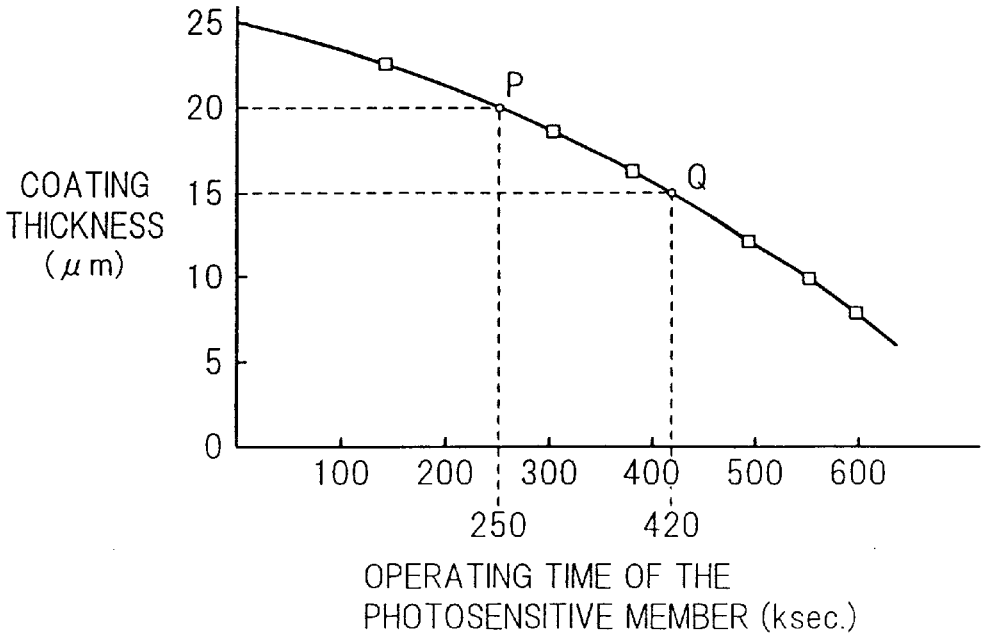
FIG. 2 PRIOR ART
FIG. 2 is an illustrative chart for explaining the relationship between the operating time of a photosensitive member and the reduction in coating thickness of the photosensitive member.
Figure 3:
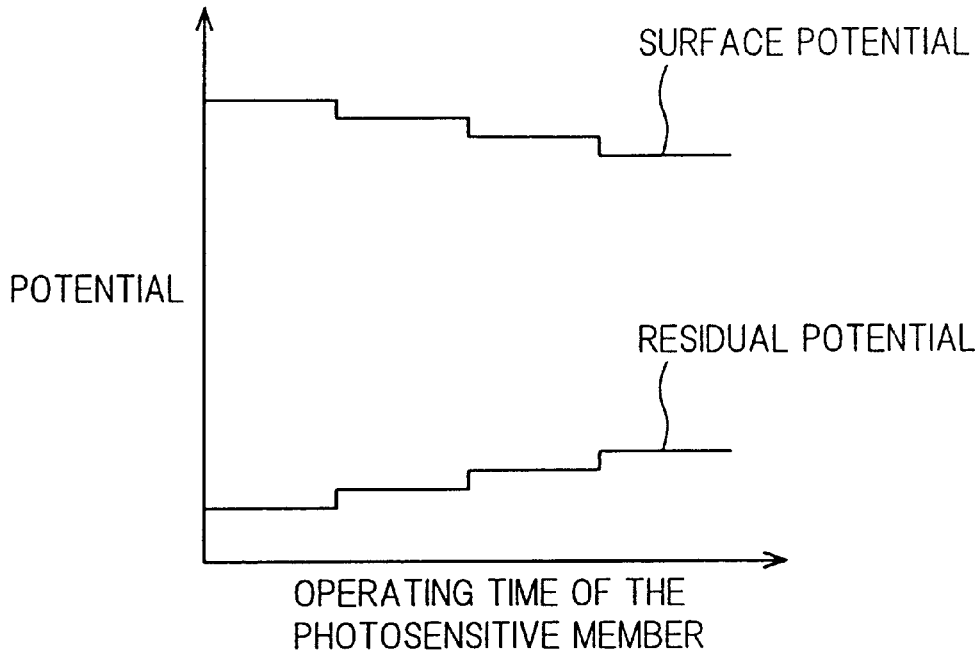
FIG. 3 PRIOR ART
FIG. 3 is an illustrative chart showing the operating time, surface potential and residual potential of a photosensitive member.
Figure 4:
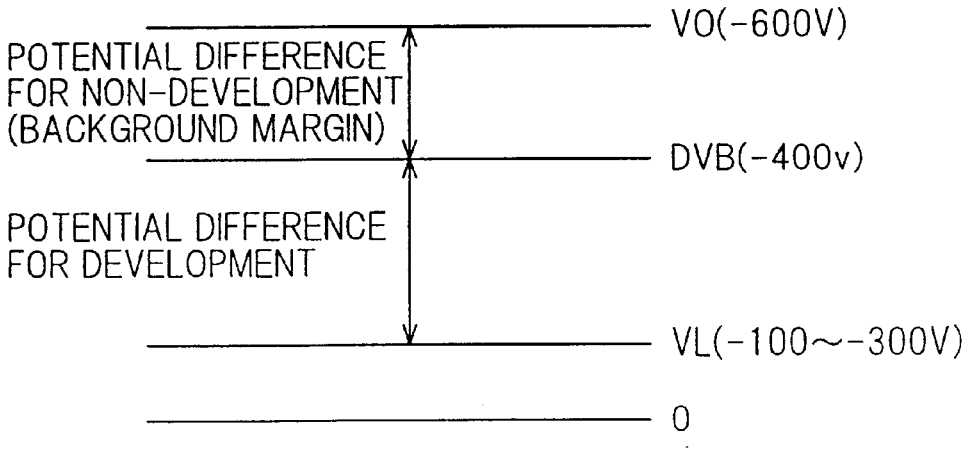
FIG. 4 is an illustrative chart for explaining the relationship between the developing potential difference and the potential difference for non-development (background margin)
Figure 5:
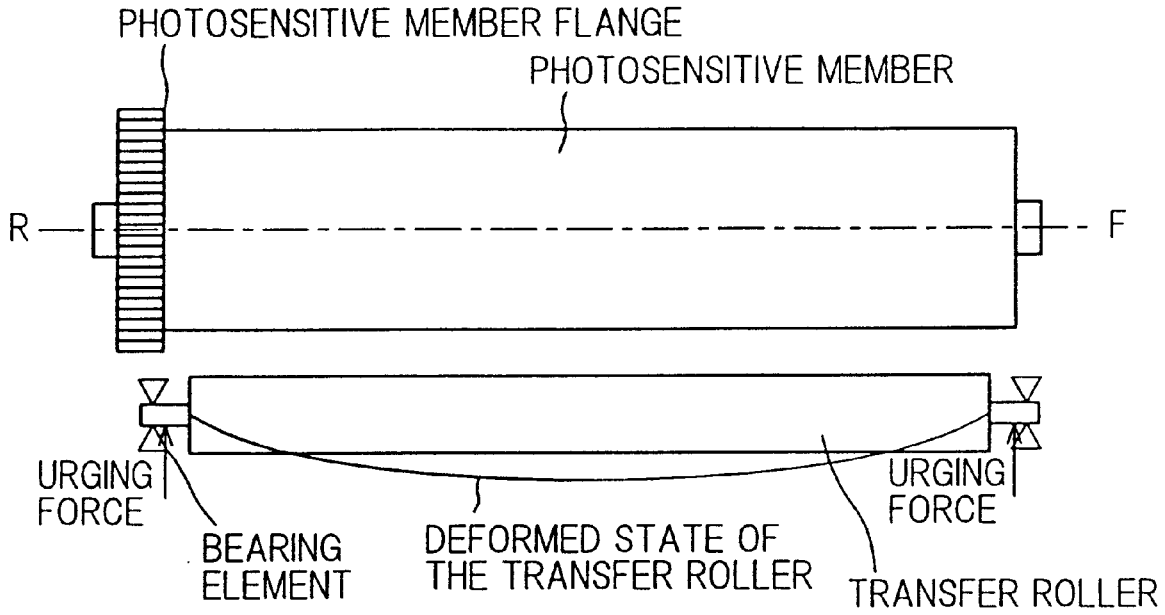
FIG.5 PRIOR ART
FIG. 5 is an illustrative diagram for explaining the deformed state of a transfer roller in the prior art.
Figure 6:
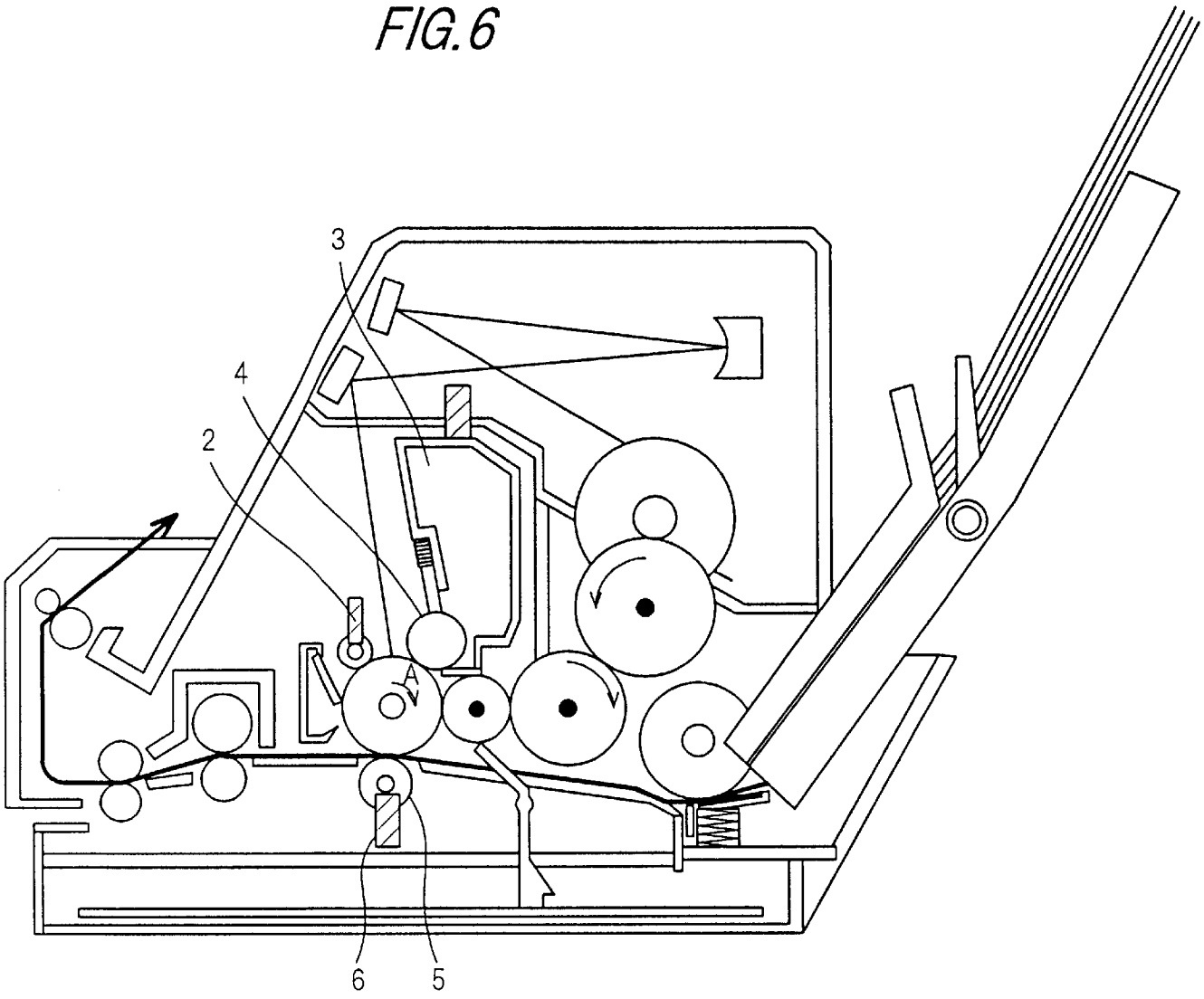
FIG. 6 is an overall sectional view showing an image forming apparatus in accordance with the embodiment of the present invention.

The embodiment of the invention will hereinafter be described. FIG. 6 is a schematic sectional view showing an image forming apparatus of the present invention. This image forming apparatus includes a negative charge type photosensitive member 1 (OPC: organic photoconductor) as the static latent image support of a cylindrical configuration having a diameter of 24 mm. This photosensitive member rotates clockwise (in the direction of arrow A) at a peripheral speed of 50 mm/s (40 rpm) and has a grounded conductive substrate.

In further detail, examples of the conductive substrate of photosensitive member 1 is composed of a cylindrical metal substrate, a thin-film sheet of aluminum, copper, nickel, stainless steel, brass or the like, or a cylindrical substrate of a polyester film, paper or metal film on which aluminum-tin-gold, indium oxide, or the like is deposited by evaporation.

Then an undercoating layer is formed for improvement of the adhesiveness of the photosensitive layer, the application performance, coverage of defects on the substrate and improvement of charge injecting performance of the charge from the substrate to the charge generating layer. As the material of the undercoating layer, resins such as polyimide, nylon copolymer, casein, polyvinyl alcohol, cellulose, gelatin, and the like, are well known. The material is dissolved in an organic solvent and is applied on the conductive substrate with a coating thickness of about 0.1 to 5 $\mu$m.

It is also known that inorganic pigments such as alumna, tin oxide, titanium oxide and the like, may be dispersed as necessary within the resin for the undercoating layer in order to improve the low-temperature and low-humidity characteristics and adjust the resistivity of the undercoating layer.

The charge generating layer is mainly composed of a charge generating material for generating charge in response to the irradiation of light, and further contains a known binder, plasticizer and sensitizer, if necessary. Examples of the charge generating material include perylene pigments, polycyclic quinon pigments, phthalocyanine pigments, metal phthalocyanine pigments, squarilium dyes, azulenium dyes, thiapyrylium dyes and azo dyes having a carbazole skeleton, styryl stilbene skeleton, triphenylamine skeleton, dibenzothiophene skeleton, oxadiazole skeleton, fluorenone skeleton, bis-stilbene skeleton, distyryl oxadiazole skeleton, or distyryl carbazole skeleton.

The charge transport layer is essentially composed of a charge transport material capable of transporting the charge generated from the charge generating material and a silicone leveling agent and a binder, and further includes known plasticizer, sensitizer etc., if necessary. Examples of the charge transport material include: electron donors such as poly-N-vinylcarbazole and its derivatives, poly-γ-carbozolylethylglutamate and its derivatives, pyreneformaldehyde condensation products and their derivatives, polyvinyl pyrene, polyvinyl phenanthrene, oxazole derivatives, oxadiazole derivatives, imidazole derivatives, 9-(p-diethylaminostyryl) anthracene, 1,1-bis(4-dibenzylaminophenyl) propane, styryl anthracene, styryl pyrazoline, phenylhydrazones, hydrazone derivatives and the like, or electron acceptors such as fluorenone derivatives, dibenzothiophene derivatives, indenothiophene derivatives, phenanthreneqinone derivatives, indenopyridine derivatives, thioxanthone derivatives, benzo[c]cinnoline derivatives, phenazine oxide derivatives, tetracyanoethylene, tetracyanoquinodimethane, promanil, chloranil, benzoinone, and the like.

The binder as a component of the charge transport layer needs to be a compatible, charge transport material and examples include polycarbonate, polyvinyl butyral, polyamide, polyester, polyketone, epoxyresin, polyurethane, polyvinyl ketone, polystyrene, polyacrylamide, phenol resin, phenoxy resin, and the like.

Fabrication of photosensitive member 1 can be done by a known dipping application. An undercoating layer is formed on the conductive substrate by immersing the conductive substrate into an undercoating application liquid having, for example, titanium oxide and nylon copolymer resin dispersed in a blended solvent of, for example, ethanol, methanol and/or methanol/dichloroethane and lifting it therefrom and drying it.

Then, a charge generating layer is formed on the conductive substrate by a well-known method including the steps of: immersing the conductive substrate into a coating liquid having a charge generating material such as an azo pigment etc., if necessary, together with a binder, plasticizer, sensitizer dispersed in an appropriate solvent such as, for example, cyclohexanone, benzene, chloroform, dichloroethane, ethyl ether, acetone, ethanol, chlorobenzene, methyl ethyl ketone etc. and lifting it for subsequent drying.

Subsequently, a charge transport layer is formed on the conductive substrate by a well-known method including the steps of: immersing the conductive substrate having been coated with the charge generating layer, into a coating liquid having a charge transport material such as an hydrazone compound, a silicone leveling agent and a binder, if necessary, together with a plasticizer, sensitizer dissolved in an appropriate solvent such as, for example, dichioroethane, benzene, chloroform, cyclohexanone, ethyl ether, acetone, ethanol, chlorobenzene, methyl ethyl ketone etc. and lifting it for subsequent drying. In this way, photosensitive member 1 is configured of a metal prime cylinder of the aforementioned material coated with a thin film of about 15 μm to 25 μm thick of organic photosensitive materials having photoconductivity.

Arranged opposing and in abutment with photosensitive member 1 is a conductive charging brush 2, as shown in FIG. 6. Charging brush 2 is configured of a fiber containing conductive materials such as carbon, a fine metal powder or the like, swathed on a metal shaft forming a roller shape. The metal shaft has a negative voltage (about −1300 V in this embodiment) applied from an unillustrated power source for voltage application so that photosensitive member 1 is uniformly charged at a predetermined potential as the photosensitive member rotates.

Next, an unillustrated laser beam scanner emits a laser beam which is modulated in accordance with the image information output from an unillustrated image processing apparatus such as a personal computer, word processor etc., so as to illuminate photosensitive member 1 in a scanning manner, to thereby form a desired static latent image, line by line, on photosensitive member 1. Description herein will be made with an example of a laser printer as the image forming apparatus, but the present invention can be needless to say applied to apparatus such as a copier, facsimile machine, etc, having the printer engine to be detailed herein.

The static latent image formed on photosensitive member 1 is visualized by providing the toner as a developer from a developing unit 3. Developing unit 3 has a developing roller 4 as a toner support arranged and axially supported in a developing casing. In this embodiment, a voltage of −450 V is applied as the developing bias voltage to developing roller 4 or developing sleeve from an unillustrated bias voltage source.

As a print medium (recording paper, etc.) is fed from a paper feeding mechanism, in synchronization with the rotation of photosensitive member 1, the toner image formed on photosensitive member 1 is transferred to the transfer medium by the action of a transfer roller 5 as a transfer device.

Transfer roller 5 is a conductive elastic roller configured of conductive urethane sponge containing conductive materials such as carbon black, metal fine powder, etc., therein having a volume resistivity of about $10^7$ Ωcm and an Asker C hardness of 30 to 50 degrees with a diameter of 13.5 mm. This transfer roller has a length shorter than the maximum paper width (in this case, the width of letter-sized paper: 216 mm), determined from the experimental result described hereinbelow and is rotated counterclockwise (in the direction of arrow B in the figure) at a peripheral speed of 49 mm/S (70 rpm). Here, Asker C hardness is a hardness unit conforming to JIS S 6050, and is measured by 'ASKER TYPE C hardness tester' manufactured by KOBUNSHI KEIKI CO., LTD, (Japan).

Transfer roller 5 is axially and rotatably supported by bearing elements 6 arranged at both ends with respect to the shaft (in the direction of its length) and is urged against photosensitive member 1 with a pressing load of 1400 gf, by unillustrated urging elements, such as springs and the like, arranged at the positions of bearing elements 6.

Transfer roller 5 has a metal shaft having a high enough rigidity and strength such as of stainless steel, nickel-plated carbon steel or the like, and having at a transfer bias voltage applied from an unillustrated bias voltage source of about +1500 V, which is of a polarity opposite to the potential of photosensitive member 1 and that of the developer, so that the toner image will transfer to the print medium by the predetermined potential difference.

The print medium having the toner image transferred thereon after the passage of the transfer station is then fed to a fixing unit where the toner image is fixed as a permanent image by pressing whilst heating at an appropriate temperature, and then the medium is discharged outside the machine.

The surface of photosensitive member 1 after having transferred the toner image to the print medium is removed of the untransferred, residual toner and cleaned by a cleaning device for a subsequent image forming process.

The First Embodiment of the Present Invention

Figure 7:
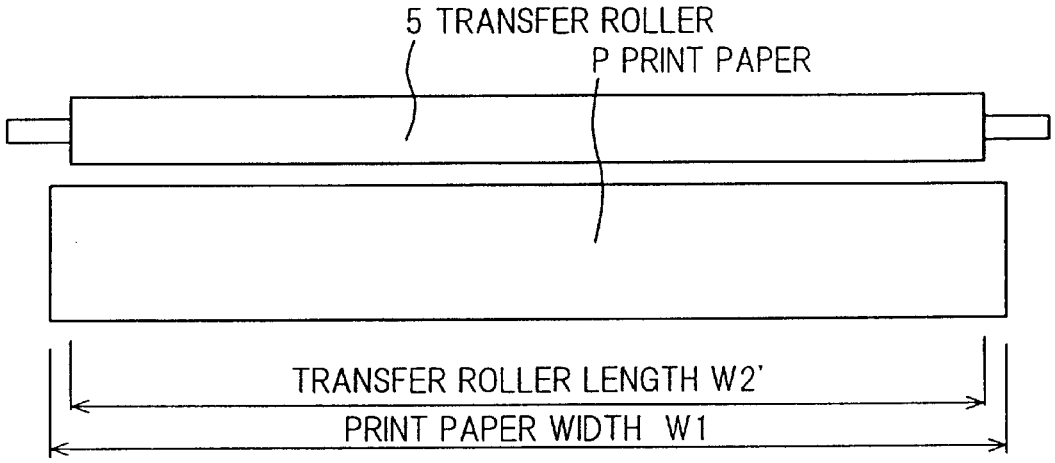
FIG. 7 is a diagram showing the relationship between the dimensions of a transfer roller and the size of paper in accordance with the embodiment of the present invention.

In the image forming apparatus as above, the transfer performance at both sides of the maximum-sized print media with respect to the length of transfer roller, and abrasion at both ends with respect to the length direction of photosensitive member 1 were evaluated by print running tests varying the length of transfer roller 5. The result is shown in Table 1 below. Hammer mill paper of letter size (width: 216 mm) was used as the print media for the print running test. The relationship between the print media width W1 and transfer roller length W2' is shown in FIG. 7.

For the evaluation of the transfer performance, a solid black pattern was formed on the whole area of the transfer medium and the optical density (ID density: the common logarithm of the inverse of the reflectance) was measured at both side parts of the print medium by a MACBETH densitometer 'RD914'. The test was performed in a mode where the black solid image should be printed with an optical density of 1.2 to 1.4. The output having a resultant optical density of not higher than 1.0 in this mode was assumed as transfer failure. The abrasion at the ends of photosensitive member 1 was evaluated by the number of prints at which fogging was first recognized at both sides of the print medium by a visual observation.

In this embodiment, photosensitive member 1 of a functionality separated type was used which is made up of an aluminum prime tube as a substrate thereof with its surface alumite-processed and laminated with a charge generating layer and a charge transport layer. The coating thickness of the photos sensitive member was set at 18 $\mu$m.

TABLE 1

(Test paper: hammer mill paper of letter size with a paper width W1 of 216 mm)

| Transfer roller length (W2') | Transfer performance at both sides | Abrasion at both ends of the OPC photosensitive member |
|---|---|---|
| 216 mm | Good | Fogging occurred at ends after 15,000 prints |
| 214 mm | Good | Fogging occurred at ends after 18,000 prints |
| 212 mm | Good | Fogging occurred at ends after 20,000 prints |
| 210 mm | Transfer failure occurred | Fogging occurred at ends after 21,000 prints |

From the above result, it has become clear that a beneficial transfer performance can be obtained if the length W2' of transfer roller 5 is shorter by 4 mm (2 mm for each side) than the print medium width W1 and that transfer problems occurred when the roller length was shorter by 6 mm. Therefore, it is judged that the correct transfer performance can be secured if the difference does not exceed 6 mm. As the transfer roller length W2' becomes shorter, the abrasion at the ends of photosensitive member 1 was improved (from 15,000 to 21,000), and the life can be lengthened by about 40% of the maximum (21,000/15,000) by reducing the length of the transfer roller by about 6 mm compared to the length of photosensitive member 1.

Figure 8:
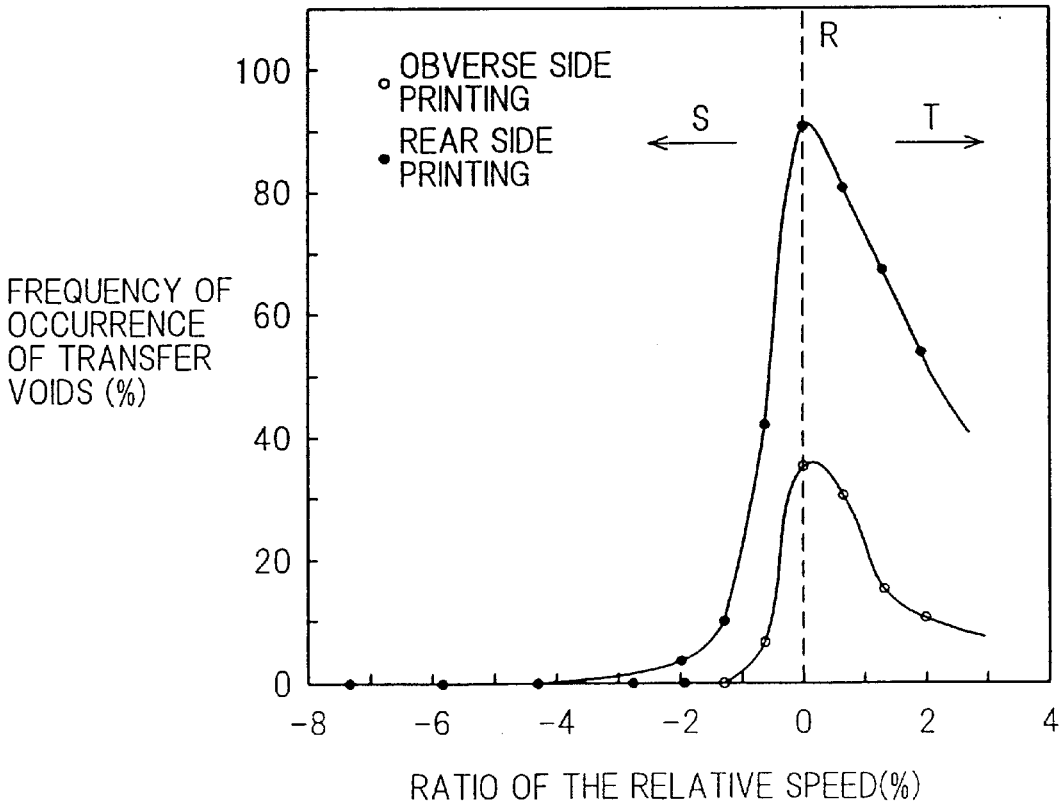
FIG. 8 is an illustrative chart representing the relationship between the ratio of the relative speed between the transfer roller and the photosensitive member and the frequency of occurrence of transfer voids, in accordance with the embodiment of the present invention.

Next, in order to further improve the image quality, investigation has been made into the dependencies of transfer voids, ratio of print expansion and contraction, jitter, dot reproducibility upon transfer roller 5. FIG. 8 is a chart showing the frequency of occurrence of transfer voids depending upon the ratio of the relative speed between photosensitive member 1 and transfer roller 5, under the above process conditions, the abscissa representing the ratio of the relative speed (%) between the two, the ordinate representing the frequency of occurrence of transfer voids.

In FIG. 8, when both have the same speed and hence the relative speed difference is zero (at point R in the figure), the occurrence frequency of transfer voids (transfer void ratio) becomes maximum and reduces as the relative speed difference increases toward the positive and negative sides. The frequency of occurrence of transfer voids reduces more markedly on the side where the relative speed difference is negative (where the peripheral speed of the transfer roller becomes lower than that of the photosensitive member, or in the direction of arrow S in the figure) compared to that on the positive side (where the peripheral speed of the transfer roller becomes higher than that of the photosensitive member, or in the direction of arrow T in the figure). Hence, as to the occurrence of transfer voids, setting the peripheral speed of the transfer roller lower than that of the photosensitive member is more advantageous.

Figure 9:
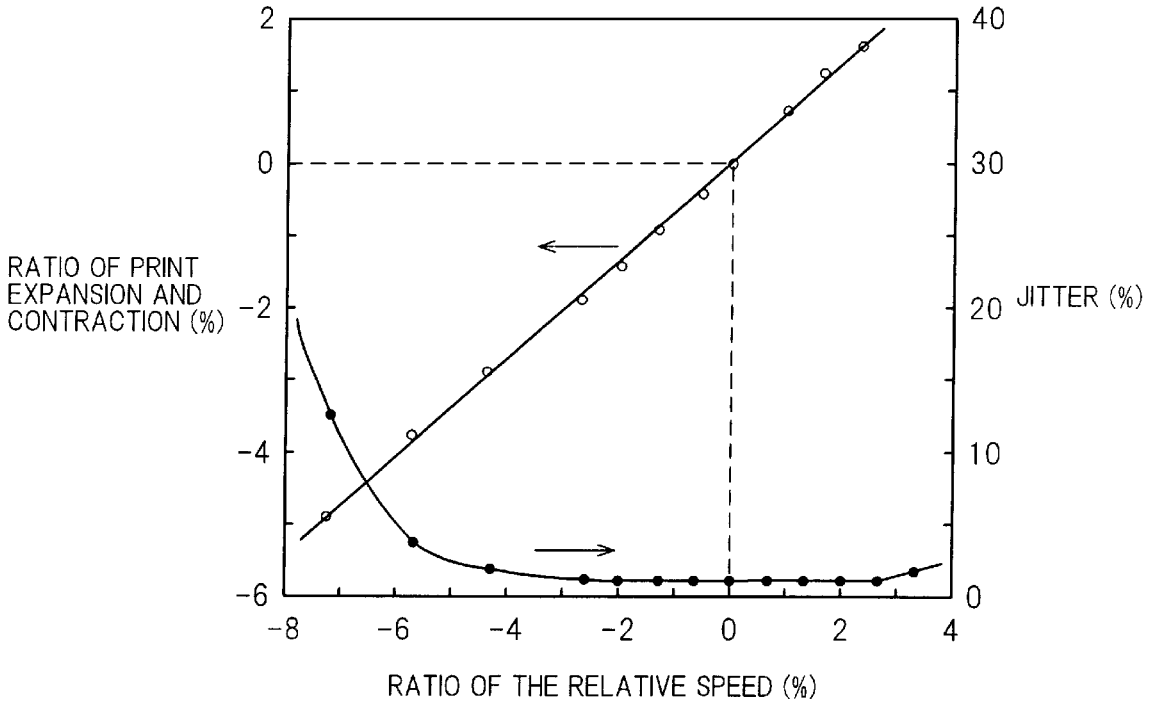
FIG. 9 is an illustrative chart showing the relationship of the ratio of print expansion and contraction and the relationship of jitter, with regards to the ratio of the relative speed between the transfer roller and the photosensitive member.

FIG. 9 shows the relationships between the relative speed difference and the ratio of print expansion and contraction and the frequency of occurrence of jitter depending upon the relative speed difference, the abscissa representing the ratio of the relative speed (%), the ordinate representing the ratio of print expansion and contraction (%) and the occurrence of jitter (%). The outlined circle points in FIG. 9 indicate the frequency of occurrence of print expansion and contraction. It is clearly understood that the ratio of print expansion and contraction is proportional to the relative speed difference between the two. The solid circle points show the occurrence of jitter. It is clearly understood that the frequency of jitter little varies as long as the relative speed difference between the two is set as low as a few percent.

Table 2 is a table showing the evaluation results of transfer voids, dot reproducibility when a print is formed by varying the relative speed difference between photosensitive member 1 and transfer roller 5. Evaluation results change at positions where the relative speed difference is around ±2%. Here, (photosensitive member>transfer roller) indicates that the peripheral speed of the transfer roller is lower than that of the photosensitive member whereas (photosensitive member<transfer roller) indicates the opposite.

TABLE 2

| Relative speed difference | Photosensitive member > Transfer roller | | | | | The same speed | Photosensitive member < Transfer roller | | | | |
|---|---|---|---|---|---|---|---|---|---|---|---|
| (%) | −5.80 | −4.64 | −3.48 | −2.32 | −1.16 | 0 | 1.16 | 2.32 | 3.48 | 4.64 | 5.80 |
| In-character voids | Good | Good | Good | Good | Good | Bad | Good | Good | Good | Good | Good |
| Dot reproducibility | Bad | Bad | Bad | Medium | Good | Good | Medium | Bad | Bad | Bad | Bad |
| Total evaluation | Bad | Bad | Bad | Medium | Good | Bad | Medium | Bad | Bad | Bad | Bad |

By judging the total evaluation results from FIGS. 8 and 9 and Table 2, if the difference between the peripheral speed of the photosensitive member and that of the transfer roller (photosensitive member>transfer roller) is smaller than about 2.3%, the requirements on all the evaluation items can be met. Therefore, the peripheral speed of the transfer roller is set so that the transfer roller will rotate slower, by less than 2.3%, than the photosensitive member while, as shown in Table 1, the length W2' of transfer roller 5 is set shorter, by less than 6 mm (less than 3 mm for each side, total, less than 6 mm), than transfer media width W1, whereby it is possible to reduce the abutment force against the photosensitive member and inhibit mechanical damage as well as substantially meeting the requirements on the image quality such as transfer voids, print expansion and contraction, jitter etc.

The Second Embodiment of the Present Invention

As the charging means for photosensitive member 1, a scorotron charger 7 is used while the diameter of photosensitive member 1 is changed from 25 mm in the first embodiment to 30 mm. Other overall configurations of the apparatus are almost the same as in the first embodiment, so that only the general description will be made as to the same components without the details.

Figure 10:
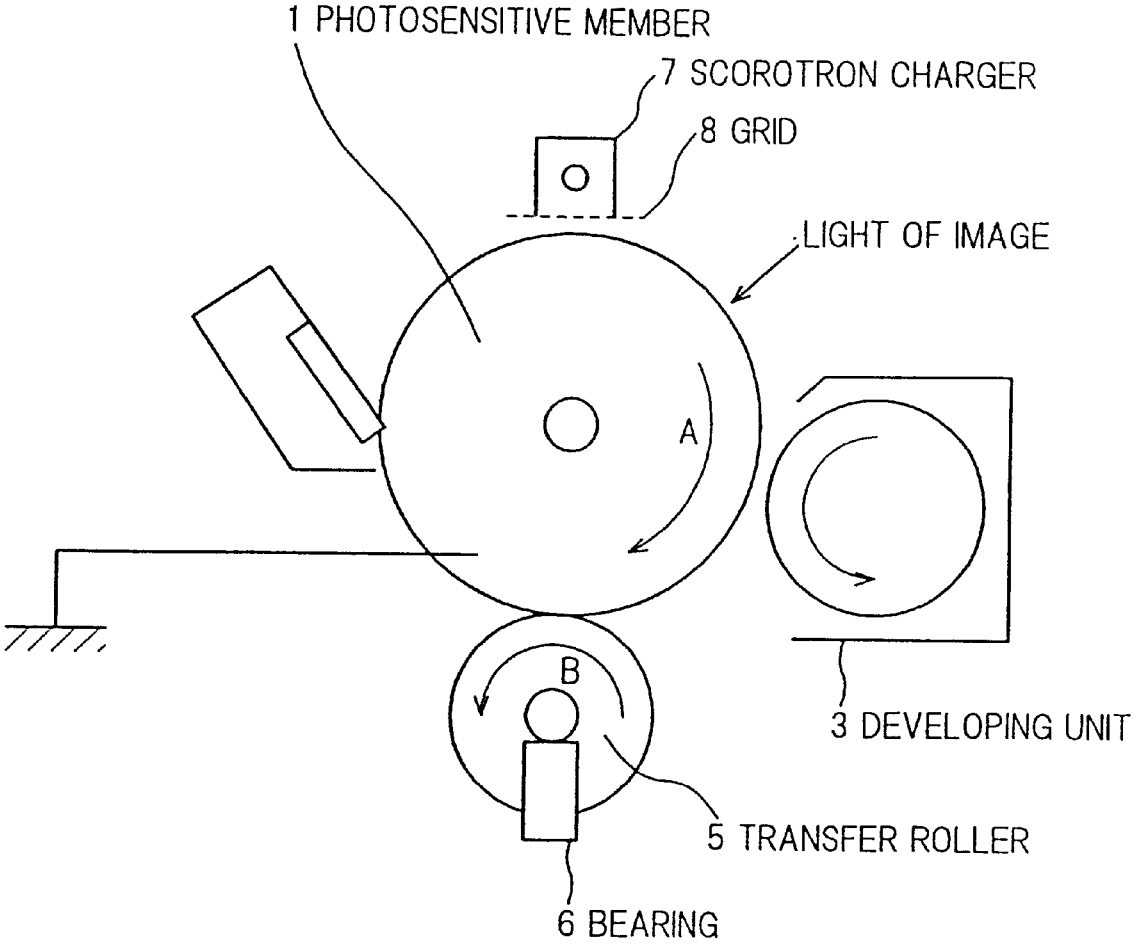
FIG. 10 is a sectional view showing essential parts of an image forming apparatus in accordance with the second embodiment of the present invention.

In FIG. 10, a negatively charged OPC photosensitive member 1 as a static latent image support has a diameter of 30 mm (the coating thickness of the photosensitive material is set at 18 $\mu$m which is the same as in photosensitive member 1 of the first embodiment) and is rotated at a peripheral speed of 50 mm/s (32 rpm) in the clockwise direction (in the direction of A in the figure) with its conductive substrate grounded. A scorotron charger 7 and a grid 8 are arranged near the image support.

By applying a predetermined voltage to grid 8, the surface of photosensitive member 1 will be charged at a uniform surface potential of the designated polarity. Subsequently, photosensitive member 1 is exposed scan-wise by a modulated laser beam from an unillustrated scanner so that a desired static latent image is formed line by line on photosensitive member 1.

The static latent image thus formed is visualized by the toner supplied from a developing unit 3. That is, a developing roller as a toner support for supporting the toner on the surface thereof is arranged in developing unit 3 and supported by an unillustrated developing casing.

Figure 11A:
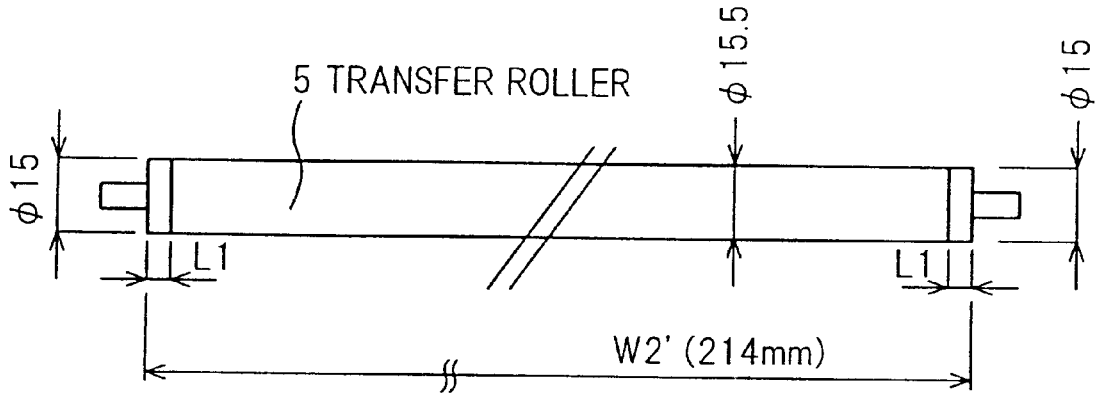
FIGS. 11A and 11B are diagrams showing transfer roller configurations in accordance with the second and third embodiments of the present invention, FIG. 11A showing a case where stepped portions are formed at the end parts, FIG. 11B showing a case where a transfer roller has a hard material at the both ends.

The toner image formed on photosensitive member 1 is transferred to the print medium (paper) by the action of transfer roller 5 as a transfer device. Transfer roller 5 is configured of, as shown in FIG. 11A, conductive urethane sponge containing conductive additives therein, having a volume resistivity of about $10^7$ Ωcm and an Asker C hardness of 45 degrees with a diameter of about 15 mm. This transfer roller has a length W2' of 214 mm, which is shorter than the maximum print media width (the width of letter-sized paper: 216 mm) and is rotated counterclockwise (in the direction of arrow B in FIG. 10) at a peripheral speed of 49 mm/s (62 rpm). The shape of transfer roller 5 is such that the middle portion has a diameter of 15.5 mm while the end parts of a width L1 (2 mm for each) have a diameter of 15.0 mm, forming stepped portions. Transfer roller 5 is axially and rotatably supported by bearing elements 6 arranged on both ends with respect to the direction of its length and is urged against photosensitive member 1 with a pressing load of 1400 gf, by urging elements, such as springs, arranged at the positions of bearing elements 6.

This transfer roller has a metal shaft which is applied with a transfer bias voltage of a polarity opposite to the potential of photosensitive member 1 and the static polarity of the toner, so that the toner image will transfer to the paper by the predetermined potential difference. The toner image on the recording medium is then fixed as a permanent image in the fixing unit by pressing it whilst heating at an appropriate temperature.

In the image forming apparatus as above, abrasion at both ends of photosensitive member 1 was evaluated by print running tests. The result is shown in table below. Hammer mill paper of letter size was used as the print media for print running tests. The abrasion at the ends of photosensitive member 1 was evaluated by the number of prints at which fogging was first recognized at both side parts of the paper by a visual observation. Here, as a comparative example, a straight, transfer roller (to be referred to as an unshaped roller in the table below) having a transfer roller diameter of 15.5 mm and a transfer roller length of 214 mm was also tested.

TABLE 3

(Test paper: hammer mill paper of letter size with a paper width of 216 mm)

| Transfer roller length | Stepped portion | Abrasion at both ends of the OPC photosensitive member (the number at which fogging first occurred) |
|---|---|---|
| 214 mm | None (unshaped roller) | 18,000 sheets |
| 214 mm | Formed (shaped roller) | 20,000 sheets |

From the above results, provision of stepped portions in transfer roller 5 improves abrasion of OPC photosensitive member 1, thus making it possible to lengthen the life of the photosensitive member by 11.1% (20,000/18,000).

The Third Embodiment of the Present Invention

Next, using transfer roller 5 of a straight shape as in the first embodiment, print running tests were carried out. In the tests, rollers made up of composite roller forming materials different in hardness at both ends were used whilst varying the transfer roller length W2'. Paper of the letter size was used as print media for print running tests. The rotational speeds of the photosensitive member and transfer roller were set at the same as in the first embodiment.

Figure 11B:
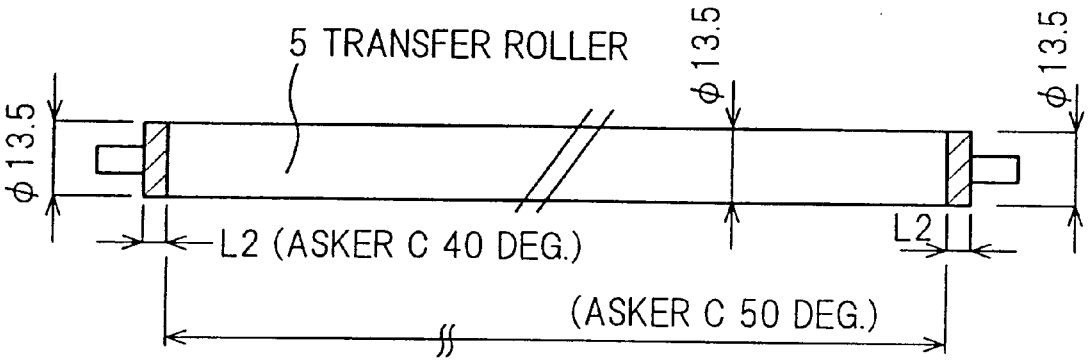

This transfer roller 5 is a straight shape having a roller diameter of 13.5 mm across its full length, but its middle portion is formed of a conductive urethane sponge having an Asker C hardness of 50 degrees while the end parts of a width L2 (3 mm for each) are formed of a conductive urethane sponge having an Asker C hardness of 40 degrees (see FIG. 11B).

Here, as a comparative example, a straight, transfer roller (to be referred to as an unshaped roller in the table below) having a transfer roller diameter of 13.5 mm and formed of a conductive urethan sponge having an Asker C hardness of 50 degrees in all portion was also tested.

TABLE 4

(Test paper: hammer mill paper of letter size with a paper width of 216 mm)

| Transfer roller length | | Transfer performance at both sides | Abrasion at both ends of the OPC photosensitive member (the number at which fogging first occurred) |
|---|---|---|---|
| 216 mm | Unshaped roller | Good | 15,000 sheets |
| | Shaped roller | Good | 17,000 sheets |
| 214 mm | Unshaped roller | Good | 18,000 sheets |
| | Shaped roller | Good | 21,000 sheets |
| 212 mm | Unshaped roller | Good | 20,000 sheets |
| | Shaped roller | Good | 23,000 sheets |

From the above results, with the same transfer roller length, the unshaped configuration having a length of 216 mm caused fogging at both ends after 15,000 prints. The unshaped roller having a length of 212 mm caused fogging after 2,000 prints while the shaped roller having a length of 212 mm caused fogging at both ends after 2,3000 prints. Thus, the roller reduced in hardness at both ends (L2) compared to the middle portion thereof enables further improvement for reduction in coating thickness of the photosensitive member. Specifically, this manipulation lengthened the photosensitive member's life by about 10 to 15% (23,000/20,000) and the manipulation of the invention lengthened the photosensitive member's life by about 53% (23,000/15,000), in total.

In accordance with the invention of the first feature, an image forming apparatus, includes: a rotatable image support; a charger for uniformly charging the image support; a light scanning and irradiating portion for illuminating the charged image support so as to form a static latent image thereon; a developing portion for supplying the developer to the static latent image on the image support to create a developer image; and a transfer roller rotatably arranged opposing and in abutment with the image support and urged against the image support by urging elements arranged around both ends thereof for transferring the developer image on the image support to a print medium, and is characterized in that the peripheral surface speed of the transfer roller is set at a speed slower, by less than 2.3%, relative to the peripheral surface speed of the image support, and the length of the transfer roller with respect to the longitudinal direction is shorter than the maximum width of the image formable print media with respect to the longitudinal direction.

When the peripheral speed of the transfer roller is equal to that of the photosensitive member as in the conventional configuration, the relative speed difference between the two is zero, producing a state similar to that where the transfer roller at rest opposes the photosensitive member whilst exerting mechanical stresses against the photosensitive member. In accordance with the first configuration, the speed of surface movement of the transfer roller is made different by the predetermined relative speed difference from that of the photosensitive member, whereby it is possible to disperse the mechanical stresses also in the lateral direction and hence inhibit the reduction in coating thickness of the photosensitive member. Further, setting of the length of the transfer roller shorter than the maximum paper width alleviates the thrust forces from the transfer roller ends acting on the photosensitive member, thus reducing abrasion of the photosensitive member at its ends. Therefore, it is possible to lengthen the photosensitive member's life and reduce the running cost and servicing cost, and hence printing cost per sheet.

Provision of the relative speed difference eliminates the defect of so-called transfer voids, in which the toner was not transferred forming white voids in the image, and also is effective in obtaining stable transfer images with a reduced ratio of print expansion and contraction and less jitters.

In accordance with the invention of the second feature, in the first configuration, the length of the transfer roller with respect to the longitudinal direction is set shorter by the distance not exceeding about 6 mm than the maximum width of the image formable print media with respect to the longitudinal direction. Therefore, hard substances coming off from the edges of the print media will hardly adhere to the transfer roller even when the print medium runs deviating from the correct position due to the runout and eccentricity of the transfer roller and/or misplacement of the print medium. As a result, it is possible to reduce abrasion at both ends of the photosensitive member to thereby length the photosensitive member's life and reduce the running cost and servicing cost and hence printing cost per sheet.

In accordance with the invention of the third feature, in the first configuration, the outside diameter at both ends of the transfer roller is smaller than that in the middle portion thereof and the both ends of the transfer roller is formed stepwise. Therefore, it is possible to reduce the abutment force of the transfer roller ends acting on the photosensitive member, thus reducing abrasion of the photosensitive member at its ends. Therefore, it is possible to lengthen the photosensitive member's life and reduce the running cost and servicing cost and hence printing cost per sheet.

In accordance with the invention of the fourth feature, in the first configuration, the transfer roller is constituted such that the hardness of each of the end portions is lower than that of the middle portion. Therefore, it is possible to reduce the abutment force of the transfer roller ends acting on the photosensitive member, thus reducing abrasion of the OPC photosensitive member at its ends. Therefore, it is possible to lengthen the photosensitive member's life and reduce the running cost and servicing cost and hence printing cost per sheet.

What is claimed is:

1. An image forming apparatus, comprising:

a rotatable image support;

a charger for uniformly charging the image support;

a light scanning and irradiating portion for illuminating the charged image support so as to form a static latent image thereon;

a developing portion for supplying the developer to the static latent image on the image support to create a developer image; and a transfer roller rotatably arranged opposing and in abutment with the image support and urged against the image support by urging elements arranged around both ends thereof for transferring the developer image on the image support to a print medium, characterized in that the peripheral surface speed of the transfer roller is set at a speed slower, by less than about 2.3%, relative to the peripheral surface speed of the image support, and the length of the transfer roller with respect to the longitudinal direction is shorter than the maximum width of the image formable print media with respect to the longitudinal direction.

2. The image forming apparatus according to claim 1, wherein the length of the transfer roller with respect to the longitudinal direction is set shorter by the distance not exceeding about 6 mm than the maximum width of the image formable print media with respect to the longitudinal direction.

3. The image forming apparatus according to claim 1, wherein the outside diameter at both ends of the transfer roller is smaller than that in the middle portion thereof and the both ends of the transfer roller is formed stepwise.

4. The image forming apparatus according to claim 1, wherein the transfer roller is constituted such that the hardness of each of the end portions is lower than that of the middle portion.

* * * * *